US008956172B2

(12) United States Patent
Matsumoto et al.

(10) Patent No.: US 8,956,172 B2
(45) Date of Patent: Feb. 17, 2015

(54) DEVICE-CONNECTING CONNECTOR

(75) Inventors: Mitsuhiro Matsumoto, Makinohara (JP); Hajime Kato, Makinohara (JP); Koichi Nakayama, Makinohara (JP); Tsuyoshi Mizushima, Makinohara (JP)

(73) Assignee: Yazaki Corporation, Tokyo (JP)

( * ) Notice: Subject to any disclaimer, the term of this patent is extended or adjusted under 35 U.S.C. 154(b) by 6 days.

(21) Appl. No.: 13/497,073

(22) PCT Filed: Aug. 4, 2010

(86) PCT No.: PCT/JP2010/063155

§ 371 (c)(1),
(2), (4) Date: Mar. 20, 2012

(87) PCT Pub. No.: WO2011/036950

PCT Pub. Date: Mar. 31, 2011

(65) Prior Publication Data

US 2012/0178291 A1 Jul. 12, 2012

(30) Foreign Application Priority Data

Sep. 24, 2009 (JP) ..... 2009-218416

(51) Int. Cl.

| | |
|---|---|
| ***H01R 13/52*** | (2006.01) |
| ***H01H 3/16*** | (2006.01) |
| ***H01R 13/74*** | (2006.01) |
| ***H01R 13/6581*** | (2011.01) |

(52) U.S. Cl.

CPC ..... *H01R 13/748* (2013.01); *H01R 13/5219* (2013.01); *H01R 13/6581* (2013.01)

USPC ..... 439/271; 200/50.1

(58) Field of Classification Search

USPC ..... 439/271, 272, 588, 274, 275, 587, 76.1, 439/76.2, 78, 359, 361–364, 652, 620, 852, 439/949, 278, 283, 284, 556, 548–550, 89, 439/277, 216, 661; 200/50.1, 302.2, 302.3, 200/216, 231, 293

See application file for complete search history.

(56) References Cited

U.S. PATENT DOCUMENTS

| | | | | | |
|---|---|---|---|---|---|
| 4,176,897 | A | * | 12/1979 | Cameron | 439/138 |
| 4,265,365 | A | | 5/1981 | Boteler | |
| 4,741,709 | A | * | 5/1988 | Jervis | 439/521 |
| 5,703,754 | A | * | 12/1997 | Hinze | 361/736 |
| 6,069,317 | A | * | 5/2000 | Wagganer | 174/650 |
| 6,147,581 | A | * | 11/2000 | Rancourt et al. | 336/65 |

(Continued)

FOREIGN PATENT DOCUMENTS

| | | | |
|---|---|---|---|
| DE | 11 2010 004266 | T5 | 1/2013 |
| JP | 2006-092776 | A | 4/2006 |
| WO | WO-2009/085975 | A2 | 7/2009 |

OTHER PUBLICATIONS

International Search Report dated Sep. 7, 2010, issued for PCT/JP2010/063155.

(Continued)

*Primary Examiner* — Renee Luebke
*Assistant Examiner* — Harshad Patel
(74) *Attorney, Agent, or Firm* — Edwards Wildman Palmer LLP

(57) ABSTRACT

A connector adapted to connect device, allows itself to be fastened with a bolt using a conventional tool, and to be downsized. A edge 9*a* of the protection rib 9 and a bearing surface 7*b* on which a bolt 10 on a fastening part 7 is tightened are formed in the same plane.

4 Claims, 5 Drawing Sheets

(56) References Cited

U.S. PATENT DOCUMENTS

| | | | | |
|---|---|---|---|---|
| 6,964,575 | B1 * | 11/2005 | Sailor | 439/76.1 |
| 7,413,446 | B1 * | 8/2008 | Jilg et al. | 439/76.1 |
| 2003/0207614 | A1 | 11/2003 | Newton | |
| 2005/0181642 | A1 * | 8/2005 | Juntwait | 439/76.1 |
| 2008/0110661 | A1 | 5/2008 | Dinh | |
| 2010/0099279 | A1 * | 4/2010 | Homme et al. | 439/78 |
| 2012/0208404 | A1 * | 8/2012 | Matsumoto et al. | 439/661 |
| 2013/0100620 | A1 * | 4/2013 | Christoph et al. | 361/752 |

OTHER PUBLICATIONS

Xiao, Jia, Office Action dated Feb. 12, 2014, Chinese Patent Application No. 201080042752.4, 11 pages, State Intellectual Property Office of the People's Republic of China.

Supplementary European Search Report dated Feb. 27, 2013, issued for the corresponding European patent application No. 10818626.3.

Office Action dated Nov. 3, 2014, issued by the European Patent Office for corresponding European patent application No. 10818626.3.

* cited by examiner

DEVICE-CONNECTING CONNECTOR

TECHNICAL FIELD

This invention relates to a device-connecting connector that is mounted directly to such a motor in an automobile.

BACKGROUND ART

For devices such a motor in an automobile such as an electric vehicle a device-connecting connector mounted to the devices are used for supply power (see e.g., PTL 1). A conventional device-connecting connector will be discussed with reference to FIGS. 6 to 10.

The device-connecting connector 101 is as shown such in FIG. 6 provided with a terminal 102, a main body 103, a shield shell 104, a shield ring 105, and a cover assembly 106.

The terminal 102 is projected from one end 103*a* of the main body 103, and is as sown a cross-sectional view in FIG. 8, bent nearly in L-Shape within the main body 103, electrically to be connected to a device 111 as shown in such FIG. 9 that is attached to from the other terminal 103*b* (downside in FIG. 8) of the main body 103. The main body 103 is formed nearly in L-shape as shown in cross-sectional view in FIG. 8, made of such synthetic resin, to make the other terminal 103*b* receive the device 111. Further, the main body 103 is provided with an opening 103*c* passing through from the other terminal 103*b* upwardly as in FIG. 8.

The shield shell 104 is formed of conductive metal, and is disposed nearly middle between the one end 103*a* and the other end 103*b* of the main body 103. And the shield shell 104 is provided with an opening 104*a* where it overlaps with the opening 103*c* of the main body 103, and a protection rib 109 is as shown in FIG. 7 deposed projected from circumference of the opening 104*a* for controlling infiltrating of water into the opening 104*a*.

Further, extended from the shield shell 104 is a fastening part 107 for fastening to a case of the device 111 with a bolt 110. The fastening part 107 is provided with a hole 107*a* for the bolt 110 passing though.

The shield ring 105 is formed of conductive metal so as to surround a circumference of the one end 103*a* of the main body 103.

A connector cover assembly 106 is provided with a plate-like main body 106*a* covering the opening 104*a* and the opening 103*c* in such a way as to cover above the protection rib 109, a tube 106*b* upstanding from an outside edge of the main body 106*a*, a cover fastening part 108 extending from an edge of the tube 106*b* in a direction parallel to the main body 106*a* and in such away to overlap with the fastening part 107. The cover fastening part 108*a* is, needless to say, disposed such a hole 108*a* for the bolt 110 passing through, as is for the fastening part 107.

CITATION LIST

Patent Literature

[PTL 1]
Japanese Patent Application Laid-Open Publication No. 2006-92,776

SUMMARY OF INVENTION

Technical Problem

With the above-mentioned configured conventional device-connecting connector 101, it interferes in the tube 106*b* of the connector cover assembly 106, i.e., the protection rib 109, if there is no room or margin in the fastening part 107 by a diameter of a tool 112 when fastening the bolt 110 with the tool 112 as shown in FIG. 10.

There have been thereby drawbacks that the above-mentioned configured device-connecting connector 101 is required of a space of room for the tool 112, so that the connector becomes upsized.

Accordingly, an object of the present invention is to provide a device-connecting connector to allow a conventional tool to fasten a bolt, and to be downsized.

Solution to Problem

In order to attain the above-mentioned object, there is provided a connector according to the present invention recited in claim 1 characterized in that a device-connecting connector comprising: a fastening part with an opening for fastening a housing to a device; a protection rib for controlling infiltrating of water from the opening into the device, projecting from a circumference of the opening, a bearing surface of the fastening part being formed in the same plane of an edge of the protection rib; and a cover adapted to cover the opening by the cover being overlapped with the protection rib.

The connector as claimed in claim 2 is characterized about the invention recited in claim 1 in that the cover is formed in a plate-like shape.

The connector as claimed in claim 3 is characterized about the invention recited in claim 1 or 2 in the fastening part and the protection rib are formed in a shield shell disposed in the housing.

Advantageous Effects of Invention

As mentioned above, according to the present invention recited in claim 1, since the bearing surface and the edge of the protection rib are formed in the same plane, it is made possible to allow itself to downsize because of no space of room for the tool.

According to the present invention recited in claim 2, since the cover is plate-shaped, it is made possible to simplify the shape, and to thereby strengthen the cover.

According to the present invention recited in claim 3, since the fastening part and the protection rib are formed in a shield shell disposed in the housing, it is made possible to downsize the device-connecting connector provided with the shield shell.

DESCRIPTION OF EMBODIMENTS

Figure 1:
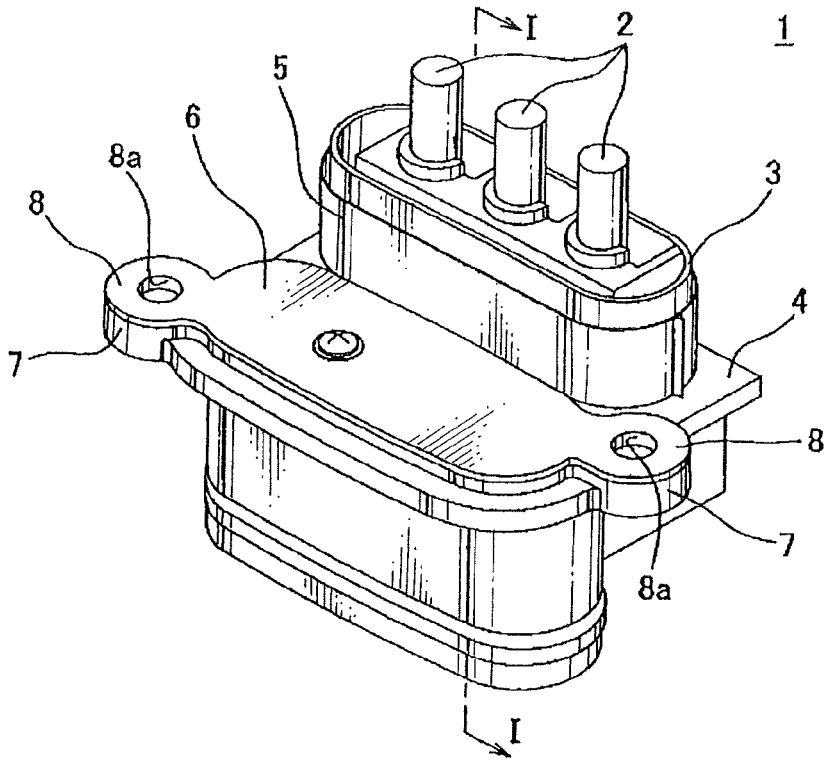
FIG. 1 is a perspective view illustrating a connector according to one embodiment of the present invention.

Then, an embodiment according to the present invention will be discussed with reference to FIGS. 1 to 5. A device-connecting connector according to one embodiment of the present invention is as shown in FIG. 1, provided with a terminal 2, a main body 3, a shield shell 4, a shield ring 5, and a connector cover assembly 6 as a cover.

The terminal 2 is projected from one end 3*a* of the main body 3, to be hereinafter described, and is bent in nearly L-shape within the main body 3 as shown in a cross-sectional view in FIG. 4, to be electrically connected to a device 11 shown in FIG. 5 that is attached to from the other end 3*b* of the main body 3 (downside in FIG. 4). And the terminal 2 is connected to a not-shown mating connector to supply such power to the device 11.

Figure 4:
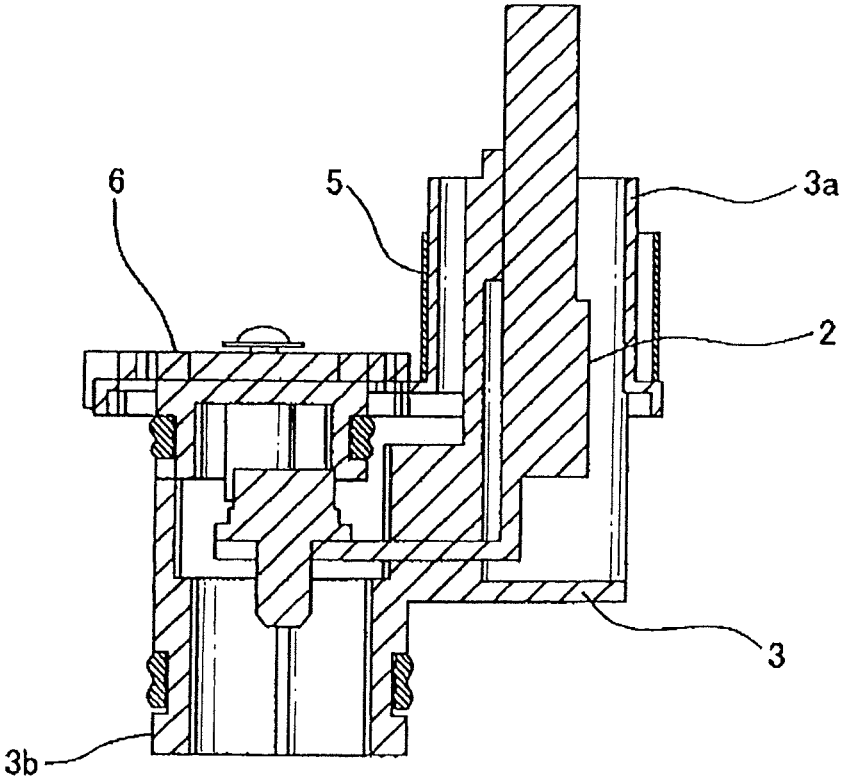
FIG. 4 is a cross-sectional view taken along I-I in FIG. 1.

The main body 3 is as shown in the cross-sectional view in FIG. 4, formed in nearly L-shape, made of isolating resin, to make the other end 3*b* receive the device 11. The main body 3 is provided with an opening 3*c* passing through from the other end 3*b* upwardly as in FIG. 4.

Figure 2:
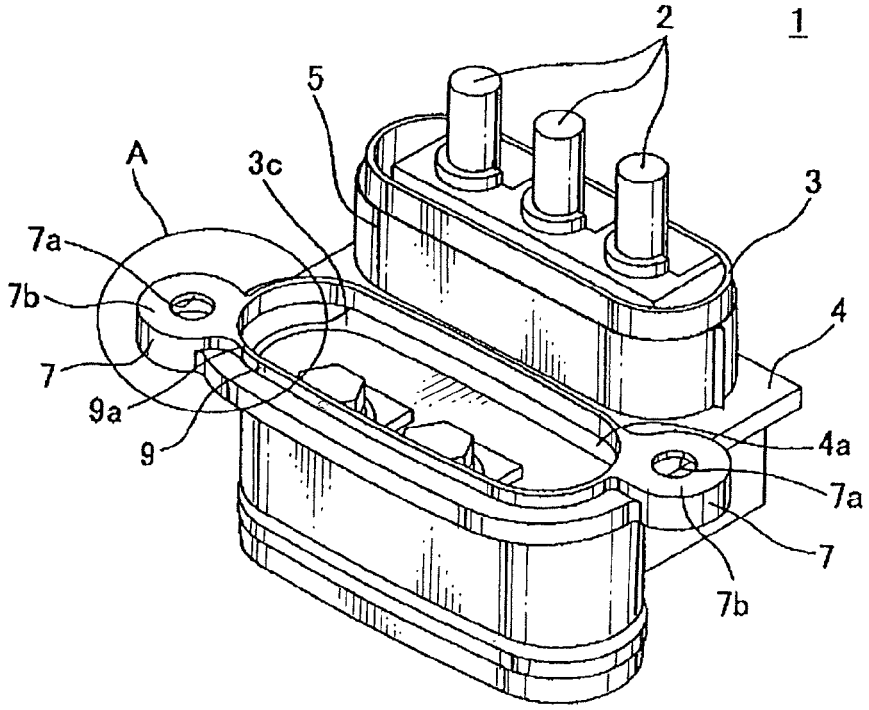
FIG. 2 is a perspective view illustrating a state in which a connector cover assembly of the connector shown in FIG. 1 is removed.
Figure 3:
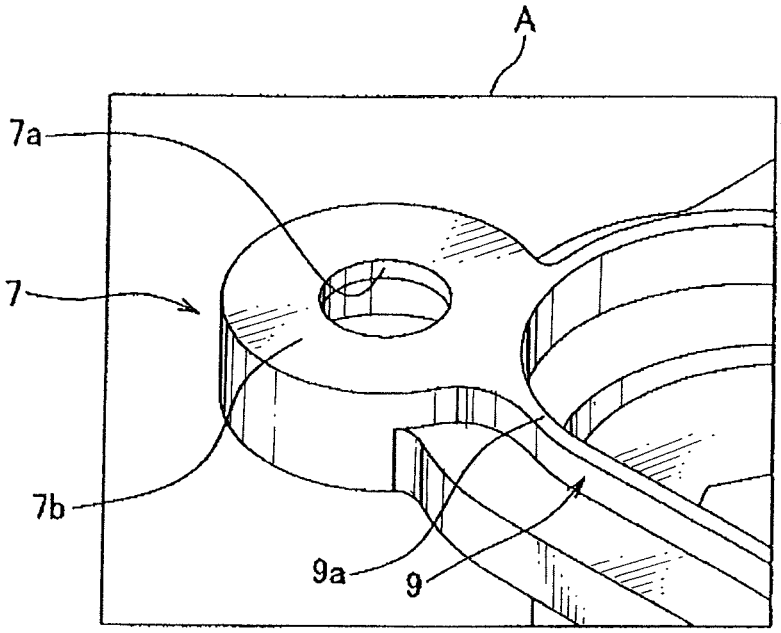
FIG. 3 is an enlarged view illustrating A-portion in FIG. 2.

The shield shell 4 is formed of conductive metal, and is disposed nearly middle between the one end 3*a* and the other end 3*b* of the main body 3. Namely, the shield shell 4 composes a part of a housing of the device-connecting connector 1. And the shield shell 4 is provided with an opening 4*a* where it overlaps with the opening 3*c* of the main body 3, and a protection rib 9 is disposed as shown in FIG. 2, projecting from circumference of the opening 4*a* so as to control infiltrating of water into the opening 4*a* and the opening 3*c*.

Further, extended from the shield shell 4 is a fastening part 7 for fastening the device-connecting connector 1 to such a case of the device 11 with a bolt 10. The fastening part 7 is formed in such a way that a bearing surface 7*b* and an edge 9*a* are arranged in the same plate, and is provided with a hole 7*a* through which the bolt 10 passes.

The shield shell 5 is formed of such conductive metal, and disposed so as to surround the one end 3*a* of the main body 3.

The connector cover assembly 6 is provided with a plate-like main body 6*a* adapted to cover the opening 4*a* and the opening 3*c* in such a way as to cover above the protection rib 9, a cover fastening part 8 extending from the main body 6*a* and formed in such a way as to overlap with the fastening part 7. Namely, the connector cover assembly 6 is formed in a plate-like shape. The cover fastening part 8 is provided with a hole 8*a* for the bolt 10 passing through as is the case with the fastening part 7.

Figure 5:
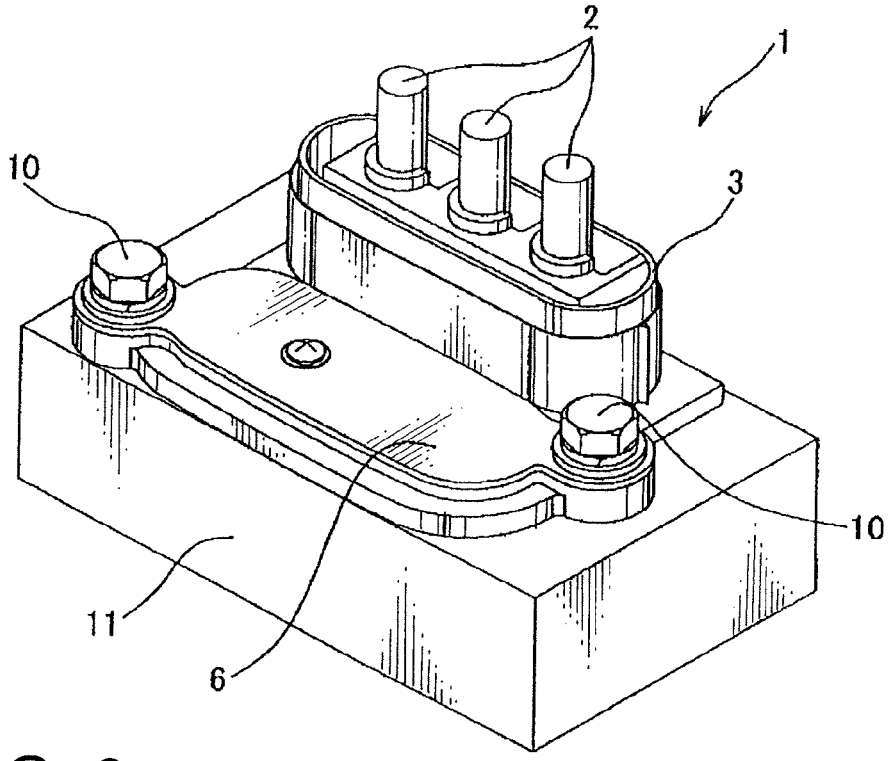
FIG. 5 is a perspective view illustrating a state in which the device-connecting connector shown in FIG. 1 is attached to a device.
Figure 6:
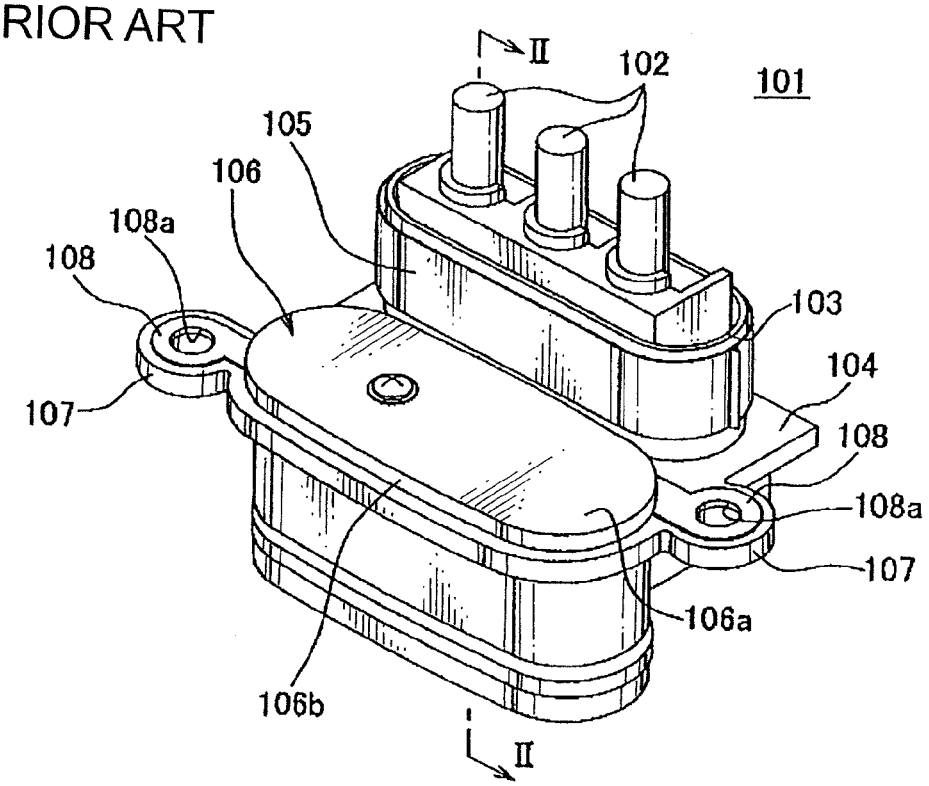
FIG. 6 PRIOR ART
FIG. 6 is a perspective view illustrating a conventional device-connecting connector.
Figure 7:
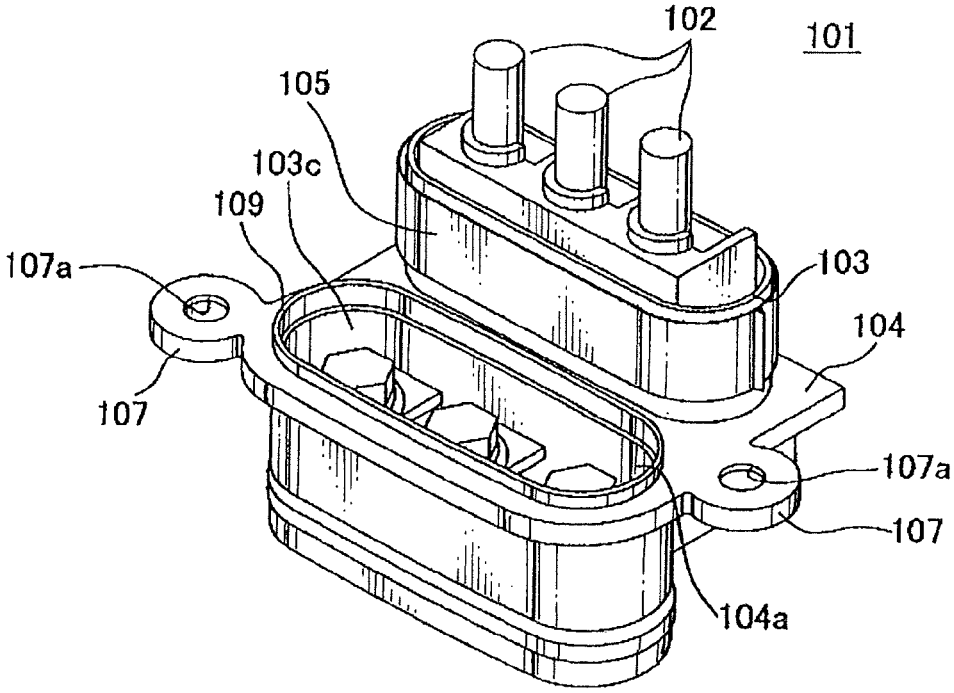
FIG. 7 PRIOR ART
FIG. 7 is a perspective view illustrating a state in which a connector cover assembly of the connector shown in FIG. 6 is removed.
Figure 8:
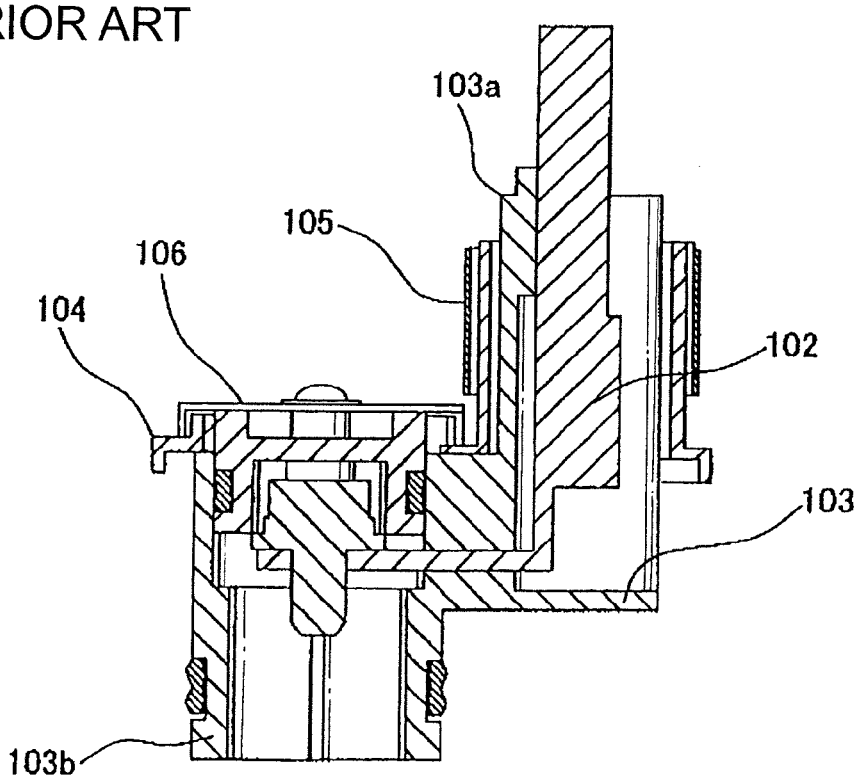
FIG. 8 PRIOR ART
FIG. 8 is a cross-sectional view taken along II-II in FIG. 6.
Figure 9:
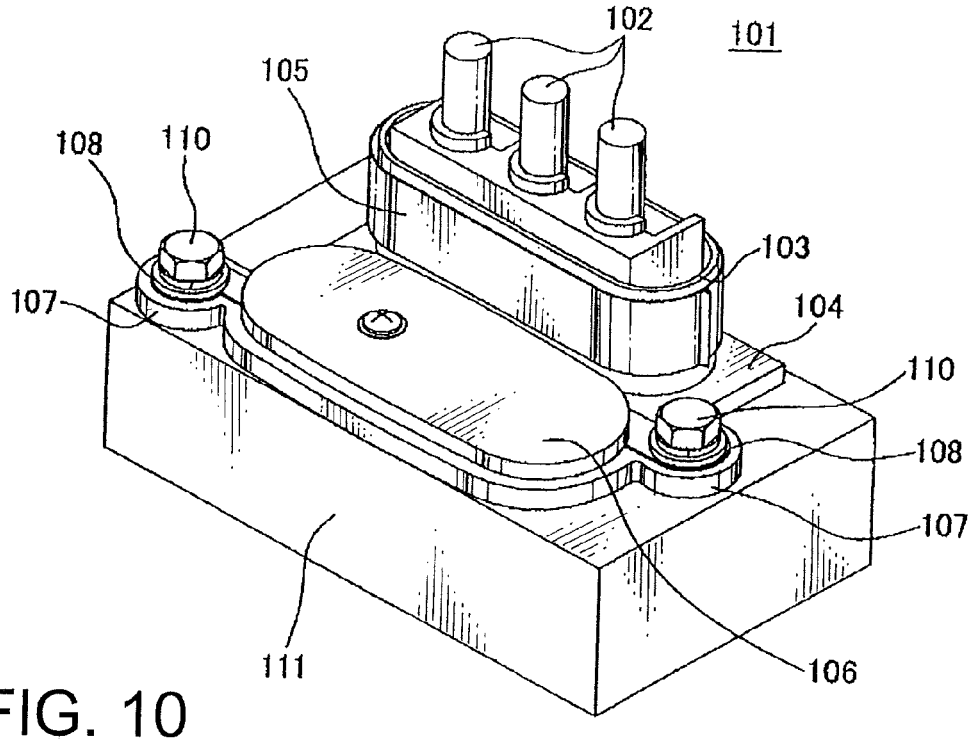
FIG. 9 PRIOR ART
FIG. 9 is a perspective view illustrating a state in which the device-connecting connector shown in FIG. 6 is attached to a device.
Figure 10:
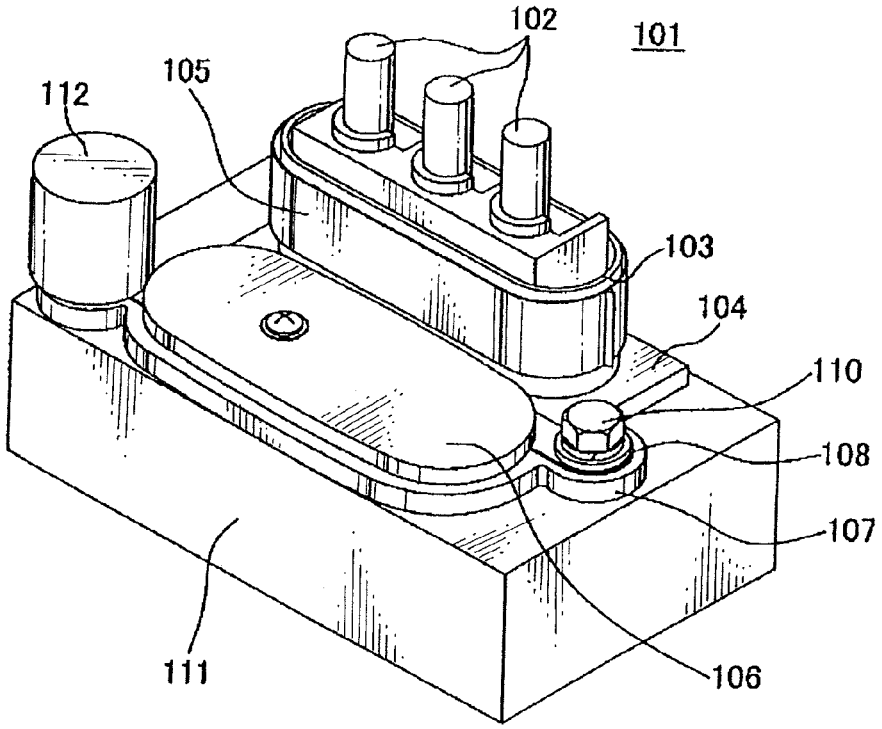
FIG. 10 PRIOR ART
FIG. 10 is a perspective view illustrating a state in which the device-connecting connector shown in FIG. 6 is attached to a device with a tool.

Then, the above-mentioned configuration of the device-connecting connector 1 is fastened as shown in FIG. 5 to such the device 11 with the bolt 10 along with the fastening part 7 and the cover fastening part 8. At this time while the tool 112 shown in FIG. 10 is used, the edge 9*a* of the protection rib 9 and the bearing surface 7*b* on which the bolt 110 on the fastening part 7 is tightened are formed in the same plane, and the connector cover assembly 6 is plate-like shaped, there is no need for designing room for the tool 112, and no interference between the tool 112 and the protection rib 9.

According to the present invention, since the edge 9*a* of the protection rib 9 in the shield shell 4 of the device-connecting connector 1 and the bearing surface 7*b* on which the bolt 110 on the fastening part 7 is tightened are formed in the same plane, there is no need for designing room for the tool 112, leading to downsize the device-connecting connector 1.

Further, since the connector cover assembly 6 to be overlapped with the shield shell 4 is plate-like shaped, the connector cover assembly 6 becomes simplified, to strengthen itself.

It should be noted that in the above-mentioned embodiment while the fastening part 7 and the protection rib 9 have been formed in the shield shell 4, but not limited therewithin, the fastening part 7 and the protection rib 9 may be disposed in the main body 3. Allowed to be adapted for the present invention is such configuration that a direction of the bolt 10 of the fastening part 7 passing through and a direction of the protection rib 9 extending is the same.

It should be noted that since the above-mentioned embodiment has anything more than shown a typical configuration of the present invention, the present invention is not limited in this embodiment. Namely, various configurations are allowed to implement without departing from the scope of the invention.

REFERENCE SIGNS LIST

1 device-connecting connector
3 main body
4 shield shell (housing)
6 connector cover assembly (cover part)
7 fastening part
7*b* bearing surface
8 cover fastening part (cover part)
9 protection rib
9*a* edge
10 bolt

The invention claimed is:

1. A device connector comprising:

a fastening part with a first opening for fastening a housing to a device;

a protection rib for controlling infiltration of water from a second opening formed in the housing into the device, projecting from a housing portion which forms a circumference of the second opening with a thickness that is narrower than a thickness of the housing portion, a bearing surface of the fastening part projecting outwardly from the projection rib in the same plane as which an edge of the protection rib is formed; and a cover adapted to cover the second opening and to surround the first opening by the cover being overlapped with the edge of the protection rib, wherein the cover is plate-shaped such that the entire cover is formed in a single plane.

2. The connector as claimed in claim 1, wherein the fastening part and the protection rib are disposed on a shield shell, which is part of the housing.

3. The connector as claimed in claim 1, wherein the cover is further adapted to cover the second opening by an edge of the cover being substantially flush with the edge of the protection rib.

4. The connector as claimed in claim 1, wherein the cover includes a first opening surrounding portion that surrounds the first opening and a second opening covering portion that covers the second opening, the first opening surrounding portion projecting outwardly from a circumference of the second opening covering portion in the same plane as which the second opening covering portion is formed.

* * * * *